US005472630A

United States Patent [19]

Ouyang et al.

[11] Patent Number: 5,472,630

[45] Date of Patent: Dec. 5, 1995

[54] LOW PHOSPHOROUS, LOW ETCH CLEANER AND METHOD

[75] Inventors: Jiangbo Ouyang, Bensalem; Edward A. Rodzewich, Flourtown; William L. Harpel, Langhorne, all of Pa.

[73] Assignee: Betz Laboratories, Inc., Trevose, Pa.

[21] Appl. No.: 217,040

[22] Filed: Mar. 24, 1994

[51] Int. Cl.[6] ..... C11D 1/34; C11D 1/72; C11D 3/37

[52] U.S. Cl. ..... 252/156; 252/79.5; 252/174.16; 252/174.21; 252/174.24; 134/42; 216/102

[58] Field of Search ..... 252/79.5, 156, 252/174.24, 174.21, 174.16; 156/665; 134/42

[56] References Cited

U.S. PATENT DOCUMENTS

| | | | |
|---|---|---|---|
| 4,085,060 | 4/1978 | Vassileff | 252/180 |
| 4,477,290 | 10/1984 | Carroll et al. | 148/6 |
| 4,762,638 | 8/1988 | Dollman et al. | 252/135 |
| 5,110,494 | 5/1992 | Beck | 252/156 |
| 5,114,607 | 5/1992 | Deck et al. | 252/156 |
| 5,200,114 | 6/1993 | Beck | 252/542 |
| 5,342,450 | 8/1994 | Cockrell, Jr. et al. | 134/3 |

FOREIGN PATENT DOCUMENTS

| | | |
|---|---|---|
| 745424 | 7/1970 | Belgium . |
| 45309 | 4/1978 | Japan . |
| 260698 | 12/1985 | Japan . |
| 5320962 | 12/1993 | Japan . |
| 1226314 | 3/1971 | United Kingdom . |

*Primary Examiner*—Paul Lieberman
*Assistant Examiner*—Michael P. Tierney
*Attorney, Agent, or Firm*—Alexander D. Ricci; Philip H. Von Neida

[57] ABSTRACT

Compositions and methods for cleaning and etching an aluminum surface with a low etch, low phosphate alkaline cleaner solution are disclosed. The preferred composition employs a stable combination of an alkali metal hydroxide, gluconic acid, a detergent source, an aluminum sequestrant, an oil emulsifier, a defoamer, and a hydrotrope.

7 Claims, No Drawings

LOW PHOSPHOROUS, LOW ETCH CLEANER AND METHOD

FIELD OF THE INVENTION

The present invention relates to the cleaning of metal surfaces to remove oil, dirt, debris and fine metal particles. More particularly, the present invention relates to alkaline cleaning formulations for aluminum surfaces.

BACKGROUND OF THE INVENTION

Alkaline cleaning treatments are employed in a variety of metal forming and coating processes. Satisfactory treatment of metals requires that any dirt and lubricants from the forming and coating operations be removed. This is particularly necessary in the production of aluminum where cleaning operations to remove oil and debris precede conversion coatings or other coating operations.

Alkaline and acid cleaners have found wide use in the cleaning of aluminum. Acid etching and cleaning with, for example, hydrofluoric acid gives good results producing clean, mirror bright surfaces. However, the use of acids for cleaning presents safety and effluent disposal problems. Acidic solutions will also attack the cleaning equipment, that is, the tank, pumps and flow lines. This necessitates that this equipment be made of stainless steel. For these reasons, alkaline cleaning and etching processes are favored in the aluminum processing industry.

Many alkaline cleaners are based on phosphate compounds. These phosphates aid in detergency, sequestration and stabilization. However, with the advent of growing environmental concerns about phosphates, their use is being reconsidered in cleaning and etching formulations.

With prior art cleaning solutions, the accumulation of oils in the bath presents a three fold problem. First, the presence of oils makes metal cleaning more difficult as the capacity of surfactants to emulsify oil from the metal becomes limited. Second, in alkaline baths, the oils may saponify and thereby contribute to foaming. Lastly, subsequent treatment of the effluent must separate out the emulsified oils prior to discharge. Higher treatment levels of surfactants are often used to remedy the problems of insufficient cleaning in the presence of oils. This may result in an increase in foam generation and difficulties in breaking the oil/water emulsion prior to the discharge of the effluent.

Virtually any material which is capable of removing oil contamination from an aluminum surface will possibly remove some aluminum. This circumstance, coupled with the economic necessity for recycling the cleaner bath, causes ever increasing amounts of aluminum in the bath. At some point, insoluble aluminum compounds will tend to drop out of the cleaning solution in the form of sludge. Such sludge can cause cleaning problems if it redeposits as a film or smut on the aluminum that has just been cleaned.

The inventive composition and methods of using avoid the problems associated with prior processes. The inventive composition offers good cleaning of aluminum, and generates a shiny surface while providing low etching of aluminum and avoiding the use of phosphates in the cleaning process.

SUMMARY OF THE INVENTION

The present invention relates to alkaline cleaner compositions and methods for cleaning aluminum surfaces. These alkaline cleaners are particularly effective at cleaning aluminum can end stock without the adverse effects of phosphate compounds and with lower aluminum etch.

DESCRIPTION OF THE RELATED ART

An alkaline cleaning and etching process is disclosed in U.S. Pat. No. 4,477,290, Carroll et al. The low temperature alkaline cleaning and etching solution for aluminum disclosed comprises alkaline metal hydroxides and a chelating agent at temperatures of from 80° to 130° F. No other ingredients such as wetting agents which would cause foaming problems are required.

U.S. Pat. No. 5,114,607, Deck et al., teaches a cleaning and etching solution and method for metal surfaces. This comprises an aqueous alkaline solution of a metal salt of gluconic acid, an alkali tripolyphosphate and a surfactant combination of a low foaming ethylene oxide-propylene oxide block copolymer and a defoaming reverse ethylene oxide-propylene oxide block copolymer.

DETAILED DESCRIPTION OF THE INVENTION

The present invention provides for compositions and methods for cleaning an aluminum surface with a low etch, low phosphate-containing alkaline cleaning solution comprising an alkali metal hydroxide and gluconic acid, the improvement further comprising an aqueous combination of a detergent, an aluminum sequestrant, an oil emulsifier, a defoamer, and a hydrotrope.

It has been discovered that this cleaning solution provides good cleaning, high waste treatability and oil splitting ability. This combination provides this cleaning with low aluminum etch, low phosphate content while remaining stable during the cleaning process and generating a shiny aluminum surface. This is important as the cleaner bath will not destabilize, plate out or fail after one application.

The detergent source can be any compound providing detergency while not interfering with the operations of the other components. One such compound is trimethylnonanol polyethyleneglycol ether with 6 moles ethylene oxide which is available from Union Carbide as Tergitol® TMN-6.

The aluminum sequestrant is preferably a polymer of acrylic acid, and acts to prevent aluminum fines from redepositing on the aluminum surface. The oil emulsifying surfactant is preferably an anionic surfactant such as potassium $C_5$ to $C_{18}$ alkoxy phenoxy carboxy phosphate. One such emulsifier is Mona NF-15 which is available from Mona Industries, Inc.

The defoaming surfactant is preferably a reverse ethylene oxide-propylene oxide (EO—PO) block copolymer surfactant of the formula $(R'O)—(RO)_n—(R—O)$ where R is an ethylene group, R' is a propylene group and n is at least 5 or greater. This defoaming surfactant is available as Pluronic 31-R1 from BASF-Wyandotte. The Pluronic® 31 R1 has the general formula $(R'O)—(RO)_n—(R'O)$ where R equals an ethylene group, R' is a propylene group, and n is at least 5. The hydrotrope is preferably one which will increase the aqueous solubility of the surfactants. One such hydrotrope is sodium alkanoate such as Monatrope 1250 available from Mona Industries, Inc.

The processes of the invention comprise contacting the aluminum surfaces to be cleaned with the aqueous cleaning compositions of the invention using any of the contacting techniques known in the art, such as conventional spray or immersion methods. Spraying is the preferred means of contacting the aluminum surface. Spray times of about 5 to 10 seconds are preferred.

An aqueous solution in accordance with the present invention comprises in volume percent:

| Ingredient | Concentration |
|---|---|
| KOH | 5 to 50% |
| Gluconic acid | 0.5 to 10% |
| Acrylic acid | 0.5 to 10% |
| Tergitol ® TMN-6 | 0.2 to 5% |
| Mona NF-15 | 0.5 to 10% |
| Pluronic 31-R1 | 0.05 to 5% |
| Monatrope 1250 | 0.4 to 20% |

The cleaning solutions are effective to clean the aluminum surfaces at temperatures from about 100° to about 150° F., preferably 130° F. The cleaner solution may be diluted to about 1 to 6% in water, preferably 3% prior to use.

Following the cleaning step, the aluminum surfaces can be rinsed with ambient tap water to remove the cleaning solution.

This invention will now be further described with reference to a number of specific examples which are to be regarded solely as illustrative, and not as restricting the scope of the invention.

EXPERIMENTAL

The evaluation of the inventive cleaner on aluminum is made by tests such as water break free, oil splitting ability, and lacquer performance after pretreatment.

The preferred aqueous concentration in accordance with the present invention, Cleaner A, is set forth in Table A. This concentrate was employed in the following tests.

TABLE A

| Ingredient | Concentration |
|---|---|
| KOH (45%) | 25.2% |
| Gluconic acid (50%) | 2.0% |
| Poly(acrylic) acid | 1.0% |
| Tergitol TMN-6 | 1.0% |
| Mona NF-15 | 2.5% |
| Pluronic 31-R1 | 0.5% |
| Monatrope 1250 | 4.0% |

Table I summarizes cleaning efficacy by estimating the percentage of water break free (% WBF) on the surface of aluminum and foaming propensity by estimating foam height. The cleaning process includes spraying on aluminum panel (Kaiser lube and Kaiser 5182 aluminum) with a 3% solution of Cleaner A for 10 seconds at 130° F. Rinsing was with tap water for 5 second. These results are reported in Table I.

TABLE I

| Cleaning Evaluation | | |
|---|---|---|
| Oil (%) | WBF (%) | Foam |
| 0.0 | 100, 100 | Low |
| 0.5 | 100, 100, 100 | Low |
| 1.0 | 98, 100, 95 | Low |
| 1.5 | 95, 90, 90 | Low |

TABLE I-continued

| Cleaning Evaluation | | |
|---|---|---|
| Oil (%) | WBF (%) | Foam |
| 2.0 | 80, 85, 90 | Low |

Table II reports a comparative test for aluminum etch rate between the inventive composition and a phosphate-containing cleaner solution. The comparative cleaner is an alkali cleaning solution commercially available as Betz DC-1675, available from Betz Laboratories, Inc., Trevose, Pa.

TABLE II

| Etch Rate | | | |
|---|---|---|---|
| Cleaner | Conc. (%) | Temp. (°F.) | Etch Rate (mg./ft$^2$/s) |
| DC-1675 | 3.0 | 130 | 1.2 |
| Cleaner A | 3.0 | 130 | 0.9 |

Tables III and IV report the results of waste treatability of the inventive composition versus Betz DC-1675. Waste treatability is the measurement of turbidity and clarity of an oil-loaded cleaner bath after acidification to pH 2. The lower the turbidity and the higher the clarity, the better waste treatability the cleaner has. Oil-splitting ability was judged by observing phase separation of 2% oil-loaded bath.

TABLE III

| Waste Treatability and Oil-Splitting Ability Kaiser Lube | | | |
|---|---|---|---|
| Cleaner | Clarity | Turbidity | Oil Splitting (?) |
| 3% Cleaner A | 30 ml | 226 ftu | No |
| 3% DC-1675 | 25 ml | 306 ftu | No |

TABLE IV

| Reynolds Oil | | | |
|---|---|---|---|
| Cleaner | Clarity | Turbidity | Oil Splitting (?) |
| 3% Cleaner A | 38 ml | 132 ftu | Yes within 30 min. |
| 3% DC-1675 | — | — | Yes within 30 min. |

As seen in Table III, the inventive composition represented by Cleaner A proved as effective as the phosphate-based cleaner at waste treatability. As seen in Table IV, the inventive low-phosphate composition was as effective as the commercial cleaner at oil splitting.

Kaiser 5182 aluminum was spray-cleaned in 3% cleaner bath for 10 seconds at 130° F. followed by a tap water rinse. The panels were deoxidized with 5% DH-1519, a commercial deoxidizer available from Betz Laboratories, Inc. After spray-applying 5% of Betz DC-1903, an aluminum pretreatment from Betz Laboratories, for 5 seconds at 90° F., clear and white lacquers were draw-down applied and cured according to manufacturer's specifications. Tables V and VI summarize the test results of the inventive composition versus a phosphate-containing alkaline cleaner.

TABLE V

| | | Valspar Vinyl Resin | | | | | |
|---|---|---|---|---|---|---|---|
| | | LACTIC ACID | | DOWFAX | | | |
| Cleaner | Deox (?) | XH | Dim-ple | XH | Fea. | Blush | HCl Blister |
| DC-1675 | No | 5B | 10 | 5B | 9.9 | None | 7 |
| Cleaner A | No | 4B | 10 | 5B | 10.0 | None | 7 |
| DC-1675 | Yes | 5B | 10 | 5B | 9.85 | None | 8 |
| Cleaner A | Yes | 4B | 10 | 5B | 9.75 | None | 6 |

TABLE VI

| | Valspar Pigmented Resin WHITE LACQUER PERFORMANCE | | | |
|---|---|---|---|---|
| | Deox | AUTO-CLAVE | | HCl |
| Cleaner | (?) | XH | Nickel | Blister |
| DC-1675 | No | 5B | Fail | 10 |
| Cleaner A | No | 5B | Fail | 10 |
| DC-1675 | Yes | 5B | Fail | 10 |
| Cleaner A | Yes | 5B | Fail | 10 |

These results indicate that the inventive composition is as effective a cleaner as a known, phosphate-based commercial aluminum cleaner.

While this invention has been described with respect to particular embodiments thereof, it is apparent that numerous other forms and modifications of this invention will be obvious to those skilled in the art. The appended claims and this invention generally should be construed to cover all such obvious form and modifications which are within the true spirit and scope of the present invention.

Having thus described the invention, what we claim is:

1. A method for cleaning and etching an aluminum surface, said method comprising applying to an aluminum surface a low aluminum etch, low phosphate-containing alkaline cleaning solution comprising, by volume percent, 5 to 50% alkali metal hydroxide and 0.5 to 10% gluconic acid, the improvement further comprising a stable combination of 0.2 to 5% of a detergent selected from the group consisting of trimethylnonanol polyethyleneglycol ether with 6 moles ethylene oxide, 0.5 to 10% of an aluminum sequestrant selected from the group consisting of poly(acrylic) acid, 0.5 to 10% of an oil emulsifier selected from the group consisting of potassium $C_5$ to $C_{18}$ alkoxy phenoxy carboxy phosphate, 0.05 to 5% of a defoamer, and 0.4 to 20% of a hydrotrope.

2. The method as claimed in claim 1 wherein said alkali metal hydroxide is potassium hydroxide.

3. The method as claimed in claim 1 wherein said defoamer is a reverse ethyleneoxide-propylene oxide block copolymer of the general structure $(R'O)—(RO)_n—(R'O)$ where R is an ethylene group, R' is a propylene group and n is 5 or greater.

4. The method as claimed in claim 1 wherein said hydrotrope is sodium alkanoate.

5. The method as claimed in claim 1 wherein said solution is sprayed onto the aluminum surface.

6. The method as claimed in claim 1 wherein said solution is sprayed onto the aluminum surfaces at a temperature of about 100° F. to about 150° F.

7. The method as claimed in claim 1 wherein said solution is diluted to about 1 to 6% in water.

* * * * *